United States Patent [19]

Onikov et al.

[11] 4,158,373

[45] Jun. 19, 1979

[54] METHOD OF AND APPARATUS FOR THREADING THE WEFT THREAD CARRIERS IN TRAVELLING-WAVE LOOMS

[75] Inventors: Eduard A. Onikov; Alexandr L. Galperin; Alexandr A. Zabotin, all of Moscow; Evgeny D. Loschilin, Moskovskaya oblast, Domodedovo; Nikolai I. Kolobanov, Moscow, all of U.S.S.R.

[73] Assignees: Tsentralny Nauchno-Issledovatelsky Institut Khlopchatobumazhnoi Promyshlennosti; Nuovo Pignone, Divisione Smit, both of U.S.S.R.

[21] Appl. No.: 855,297

[22] Filed: Nov. 28, 1977

Related U.S. Application Data

[63] Continuation-in-part of Ser. No. 724,762, Sep. 20, 1976, abandoned.

[51] Int. Cl.[2] ..... D03D 47/26

[52] U.S. Cl. ..... 139/436; 139/224 A

[58] Field of Search ..... 139/436, 224 A, 450

[56] References Cited

U.S. PATENT DOCUMENTS

| | | | |
|---|---|---|---|
| 3,732,896 | 5/1973 | Jekl et al. | 139/436 |
| 3,835,893 | 9/1974 | Galperin et al. | 139/436 |
| 3,989,069 | 11/1976 | Hrdina et al. | 139/436 |

*Primary Examiner*—Henry Jaudon

*Attorney, Agent, or Firm*—Steinberg & Blake

[57] ABSTRACT

The present invention relates to methods of and apparatus for threading the weft thread carriers and may be most effectively used on travelling-wave looms. In this method, the weft thread is introduced into a thread tensioner while the last coil thereof is being wound with gripping before a straight section is formed, after which the thread is shifted by being unwound from a bobbin in the direction of feed, with the carrier admitted into the looming-up zone at this time, this shifting being maintained up to the moment of separation of the straight section from the coils. In an apparatus for realizing this method, there is provided a stationary cam for jaws located in a central angle of a disk within a sector limited by a region of divergence of mechanical trajectories of the disk and a conveyer and a region corresponding to the last turn of the threadguide around its axis which is close to the axis of rotation of the disk and shifted relative to the axis of symmetry of the carrier spool.

6 Claims, 18 Drawing Figures

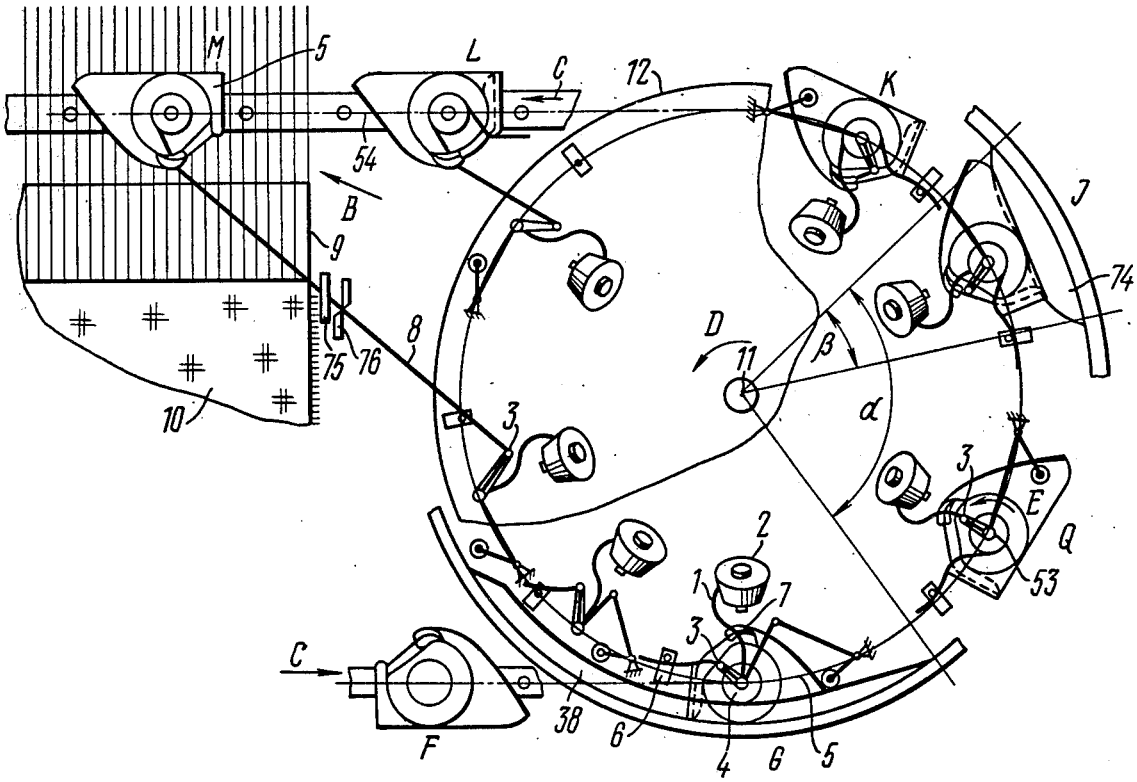

METHOD OF AND APPARATUS FOR THREADING THE WEFT THREAD CARRIERS IN TRAVELLING-WAVE LOOMS

This application is a continuation-in-part of our copending application Ser. No. 724,762 filed September 20, 1976, now abandoned.

FIELD OF THE INVENTION

The present invention relates to travelling-wave looms and, more particularly, it relates to methods of and apparatus for threading the weft thread carriers in these looms.

BACKGROUND OF THE INVENTION

At present, there are known methods of threading the weft thread carriers, consisting in that a weft thread is unwound from a bobbin to be wound in the form of coils by a threadguide onto a spool of a carrier, with the thread introduced into a thread tensioner of the carrier and with its free end gripped prior to winding. After the winding of the thread is completed, the carriers are admitted into a looming-up zone, with a straight section of the weft thread being at the same time formed between this carrier and the threadguide, and as the carrier and the threadguide depart from each other, the weft thread is introduced into the thread tensioner and the straight section thereof is formed. Sequentially, the coils of the weft thread are separated at the edge of the looming-up zone from the straight section.

Apparatus for realizing the known method comprise threadguides arranged on a horizontal rotatable disk and installed so as to be free to rotate around their axes extending parallel to the axis of rotation of the disk for winding the thread, which is unwound from the bobbin, onto the spools of the carriers in the form of coils. Each carrier is provided with a thread tensioner with jaws for gripping the thread, driven into motion by a stationary cam. The apparatus is also provided with a conveyer for propelling the carriers and admitting each of them in succession into the looming-up zone, and with a device for separating the straight section formed when the carriers are being admitted into said zone from the coils.

The threading of the carriers in this known apparatus is as follows.

As soon as the mechanical trajectories of the carriers and the threadguides coincide and the axes of rotation of the spools of the carriers and of the threadguides are aligned, the weft thread of a length sufficient for a pick is wound onto the spools of the carriers due to turning of the threadguides around their axes and due to nipping of the weft thread end by the grips. Now, the weft thread is unwound from the bobbins. Then, the rotation of the threadguides around their axes is stopped, the winding of the weft thread onto the spools of the carriers interrupted and, while the mechanical trajectories of the carriers and the threadguides are diverging, the weft thread is introduced into the thread tensioners of the carriers, whereby a straight section thereof is formed between the thread tensioners of the carriers and the threadguides due to this thread being unwound from the spools of the carriers.

Sequentially, the carriers admit the weft thread into the looming-up zone wherein it is first interlaced with the ending warp threads, while being unwound from the spools of the carriers, and thereafter gripped and cut with the aid of a device located next to the looming-up zone, as a result of which the coils of the weft thread placed on the spools of the carriers are separated from the main reserve thereof on the bobbins.

This known method of threading carriers has the following disadvantages. Due to the introduction of the weft thread into the thread tensioners of the carriers when the mechanical trajectories of the carriers and the threadguides diverge, the reliability of this process is reduced. This is a result of the fact that during this period the spool starts rotating at a variable speed, while the carrier is propelled by the conveyer along the guideways with certain oscillations which renders the weft thread loose, and the latter fails to be engaged by the thread tensioner of the carriers.

Additionally, with this threading being performed at different mechanical trajectories of the carrier and the threadguide, the latter must be strictly oriented relative to the carrier by being positioned in a definite zone in front of the thread tensioner. Otherwise, the threadguide, while operating, may bump into the body of the carrier or the thread tensioner. Such a strict orientation requires that the accuracy of manufacture of the drive of the threadguide and the carriers, as well as the accuracy of mechanical trajectories thereof, be increased.

Formation of the straight section of the weft thread, with the mechanical trajectories of the carriers and the threadguides diverging, due to unwinding of the thread from the spools of the carriers before the latter enter the looming-up zone requires that during each cycle of winding the amount of the weft thread wound onto the spools of the carriers be greater than necessary for forming the cloth. This makes it necessary to increase both the speed of rewinding of the weft thread and the capacity of the carrier spools and, therefore, the size thereof.

Interlacing of the weft thread with the edging warp threads before the former is gripped and cut near the looming-up zone renders the selvage of the cloth slack due to the overdosage of the weft thread caused by the fact that the latter, while being interlaced with the warp threads, is disposed at a great angle to the fell of the cloth, and the tension applied thereto markedly decreases in the process of displacement thereof towards the fell.

It is an object of the present invention to provide a method of and an apparatus for threading the weft thread carriers, which will ensure reliable engagement of the weft thread by the thread tensioner.

The principal object of the invention is to reduce the breakage rate of the weft thread during winding.

BRIEF DESCRIPTION OF THE INVENTION

These and other objects are attained by providing a method of threading the weft thread carriers, comprising in that a weft thread is unwound from a bobbin to be wound in the form of coils by a threadguide onto a spool of a carrier, with the thread being introduced into a thread tensioner of the carrier and at the free end thereof gripped prior to winding, then, after the winding is completed, the carriers are admitted into a looming-up zone, with the straight section of the weft thread being in this case formed between this carrier and the threadguide, after which the coils of the weft thread are separated at the edge of the looming-up zone from the straight section. In accordance with the invention, the weft thread is introduced into the thread tensioners while the last coil thereof is being wound with gripping before the straight section is formed, after which the thread is shifted, by being unwound from the bobbin in the direction of feed, with the carrier admitted simultaneously into the looming-up zone, this shifting being maintained up to the moment of separation of the straight section from the coils.

In an apparatus for effecting this method comprising threadguides arranged on a rotatable horizontal disk and installed so as to be free to intermittently rotate around their axes extending parallel to the axis of rotation of the disk for winding the weft thread unwound from a bobbin in the form of coils onto a spool of a carrier provided with a thread tensioner with jaws for gripping the thread driven into motion from a stationary cam, a conveyer for admitting each carrier in succession into a looming-up zone and a device for separating from the coils the straight section formed when the carrier is admitted into said zone. In accordance with the invention, the stationary cam of the jaws is located in a central angle of the disk within a sector limited or bound by the region of divergence of the disk and the conveyer and the region corresponding to the last turn of the threadguide around its axis which is close to the axis of rotation of the disk and shifted with respect to the axis of symmetry of the spool, whereby the threading of the thread tensioners is accomplished before the straight section is formed, one of the jaws being installed movably towards the carrier spool.

Such a method of threading the thread tensioners ensures reliability of this operation since during threading the spools are stationary, the threadguides and the carriers move along a common trajectory, i.e., there is no movement thereof relative to each other, and the threading itself is accomplished at the moment when the threadguides are in the immediate vicinity of the thread tensioners. As a result of the above, the possibility of the weft thread becoming loose and missing the thread tensioners of the carriers is eliminated. Besides, such a combination of the processes of winding and threading does not call for strict orientation of the carrier and the threadguide when the latter stops rotating. This is due to the fact that since the thread is already gripped the trajectory of exit of the threadguide from the zone of the carrier is immaterial.

In addition, the unwinding of the weft thread from the bobbin in the direction of feed, with this motion maintained thereafter, makes it possible to wind onto the spools of the carriers a smaller amount of the weft thread at a given weaving width of the loom, hence, to decrease both the rewinding speed and the bulk of the spool of the carriers. This is achieved due to the fact that with the carriers and the threadguides diverging, the unwinding occurs after the thread has been gripped by the thread tensioner.

In accordance with the method of the invention, in the process of unwinding of the thread in the direction of feed thereof, the separation of the straight section is performed before it gets interlaced with the edging warp threads.

This allows obtaining a compact selvage of the cloth and a short open fringe because during movement right up to the fell of the cloth the weft thread is not interlaced with the warp threads, is straightened out and permanently kept under tension applied by the thread tensioner of the carrier. Within the zone close to the fell of the cloth, this thread is nipped by the grip and cut by the knife and only then is interlaced with the warp threads, a short open fringe remaining at the selvage.

Also, in accordance with the invention, the movable jaw is seated on a bell crank whose pivot axle is disposed behind the spool in the direction of advance of the carriers, and a free arm of this ball crank cooperates with the cam of the jaws for forming therebetween a space through which the threadguide with the weft thread passes for the latter to be gripped before the straight section is formed. Such an arrangement facilitates maintenance, does not encumber the servicing and threading zones and simplifies the structure of the apparatus in its entirely.

BRIEF DESCRIPTION OF THE DRAWINGS

Given below is a detailed description of the present invention with reference to the accompanying drawings, wherein.

Figure 1:
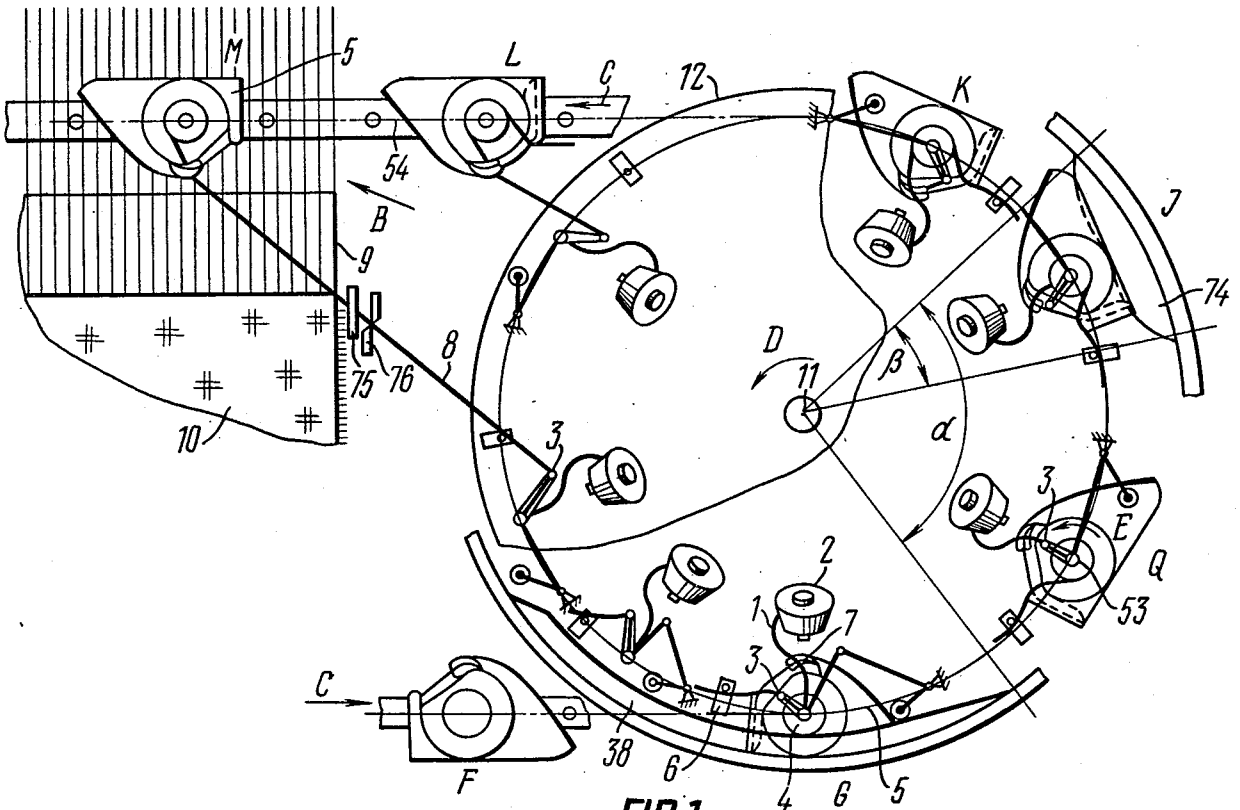
FIG. 1 shows schematically an apparatus for carrying out the method of threading the weft thread carriers, top view.

Essentially, the herein disclosed method consists in that a weft thread 1 (FIG. 1) is unwound from a bobbin 2 to be sequentially wound in the form of coils, by a threadguide 3, onto a spool 4 of a carrier 5, the free end of the thread being nipped before the winding by a grip 6. When the last coil of the weft thread 1 is being wound, the latter is introduced into a thread tensioner 7 of the carrier 5 and gripped, after which the thread is shifted while being unwound from the bobbin 2 meanwhile the carrier 5 is admitted into a looming-up zone "B" whereby a straight section 8 of the thread 1 is formed intermediate of the carrier 5 admitted into the zone "B" and the threadguide 3. The straight section 8 is thereafter severed from the coils and the thread 1 is interlaced with the edging warp threads.

By the looming-up zone "B" is meant a loom zone wherein under the action of a cloth forming mechanism 9 a cloth 10 is formed from warp and weft threads. The term "coil" implies the weft thread of a length equal to a length of a circumference of a cylindrical surface of the spool 4 of the carrier 5.

The apparatus for realizing the proposed method includes a disk 12 (FIG. 1), placed horizontally and rotatably around an axis 11. This disk 12 (FIG. 2) is bowl-shaped and closed from above with a cover 12*a*. Mounted on this disk along the perimeter thereof are the threadguides 3 each of which is coupled with a gear 13 and a fixing disk 14. The disk 12 accommodates a drive for each threadguide. This drive causes the threadguides to intermittently rotate making a definite number of revolutions, to stop in a definite position and to dwell. The drive includes a cam 16 installed on a stationary shaft 15, which cam imparts, through a roller 17 and an axle 18, a reciprocating motion to a toothed sector 19 installed on an axle 20. The sector 19 is meshed with a gear-semicoupling 21 installed on a shaft 22. Mounted on the same shaft through a sliding key 23 is an upper semicoupling 24 urged against the gear-semicoupling 21 by a spring 25 as well as a command disk 26. Rigidly secured to the shaft 22 is a gear 27 which, through gears 28, 29 is permanently meshed with the gear 13 mounted on the threadguide 3. On the cover 12*a* mounted are three-arm levers 30 (FIG. 3) each of which is provided with rollers 31, 32, 33. The roller 31 cooperates with the fixing disk 14, the roller 32 cooperates with the command disk 26, and the roller 33 cooperates with a cam 34 (FIG. 2) of the three-arm lever. This cam is stationary on a frame 35 of the loom. On the cover 12*a* are also installed levers-compensators 36 (FIG. 3) which are free to turn around axles 37 when actuated by a cam-compensator 38 (FIG. 2) stationary on the frame 35 of the loom and acting upon the levers-compensators through rollers 39 (FIG. 3). The roller 39 is pressed against the cam by a spring 40.

Also mounted on the cover 12*a* are forked levers 41 raising and lowering the upper semicouplings 24 (FIG. 2) whereby the threadguides are caused to rotate and dwell. The forked levers are turned by a cam 42 stationary on the frame 35 of the loom, through the medium of rollers 43 (FIG. 3), levers 44 and axles 45 whereon the forked levers are installed.

In the proposed apparatus, mounted on the cover 12*a* are also thread tensioners 46 (FIG. 2) and bobbins 2. In the bottom plane of the disk 12 are mounted the grips 6 (FIG. 1) each of which comprises a stationary jaw 47 rigidly secured on the disk 12 (FIG. 2), a movable jaw 49 being urged by a spring 48 to the stationary jaw. Displacement of the movable jaw 49 relative to the stationary jaw 47 is effected with the aid of a cam 50 fixedly installed on the frame 35 of the loom and acting upon the movable jaw through the medium of a roller 51 and a lever 52.

Thus several winding heads are mounted on the disk 12, which continously rotate together with the disk around the axis 11 (FIG. 1). Each of these beads includes the threadguide 3 intermittently rotating around its axle 53 (FIG. 2), the threadguide drive, the three-arm lever 30 (FIG. 3) to retain the threadguide, the forked lever 41 to change over the threadguide drive coupling, the lever-compensator 36, the thread tensioner 46 (FIG. 2), the bobbin 2 containing the weft thread and the grip 49 for the end of the weft thread. With the disk rotating, each winding head alternately winds the weft onto the spools of the carriers.

Figure 4:
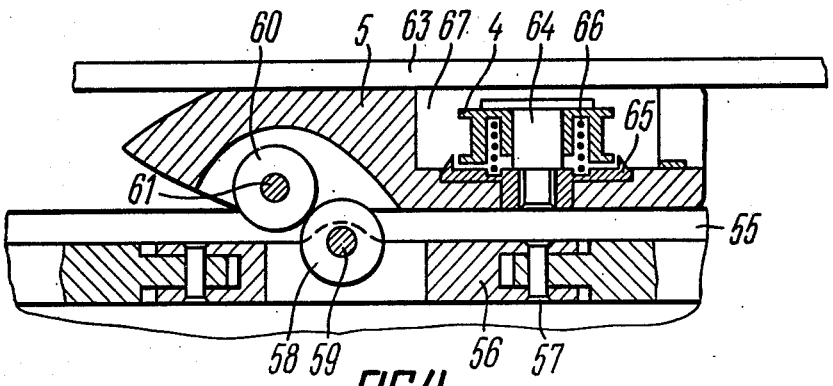
FIG. 4 is a sectional view of a carrier with a conveyer of the mechanism for propelling the carriers.
Figure 5:
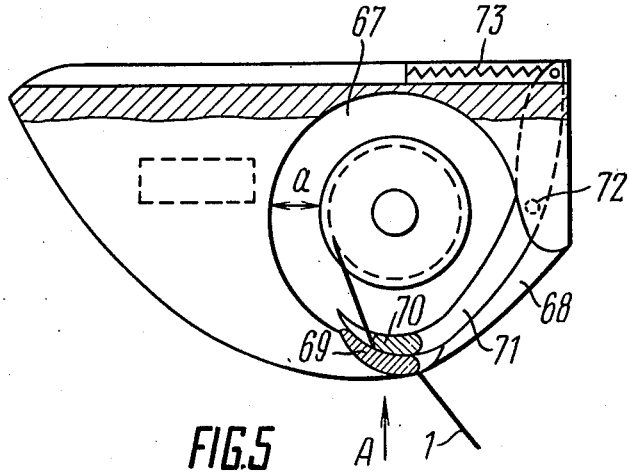
FIG. 5 shows a carrier, top view.

In addition, the threading apparatus includes a conveyer 54 (FIG. 2) for propelling the carriers and a lower guideway 55. The conveyer comprises an endless chain with links 56 (FIG. 4) interconnected by pins 57. The links carry driving rollers 58 which rotate freely around axles 59 and acting upon rollers 60 rotating freely around axles 61 accommodated in the body of the carriers. The disk 12 (FIG. 2) mounts teeth 62 meshed with the links of the chain, therefore, when the disk 12 is driven into motion by the electric motor of the loom, the conveyer is driven into motion too, as a result of which the roller 58 (FIG. 4) acts upon the roller 60 and the carrier 5 is caused to move between the lower guideway 55 an upper guideway 63. The carrier is provided also with a spool 4 loosely seated on an axle 64 coupled with a bushing 65 mounted in the body of the carrier 5. The spool 4 is braked when pressed against the upper flange of the axle 64 by a spring 66. The spool is placed within a carrier well 67 (FIG. 5). Provided between the spool and the well wall is a free space "a" wherein the threadguide moves when the thread coils are being wound. Additionally, inside the body of the carrier there is provided a free space 68 adapted to let in and out the threadguide before and after the winding of the coils, as a result of which the threadguide does not rise when entering the carrier body.

Figure 6:
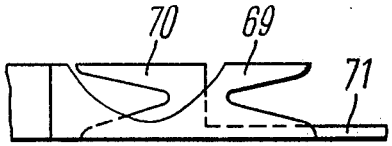
FIG. 6 shows the configuration of jaws of a carrier thread tensioner, view along arrow A of FIG. 5.

The carrier is provided with the thread tensioner composed of a stationary 69 and a movable 70 jaws (FIGS. 5, 6). The stationary jaw 69 is rigidly secured on the carrier body, while the movable jaw 70 is mounted on a bell crank 71 with a pivot 72. The free end of the bell crank 71 carries a spring 73 urging the movable jaw against the stationary one. Passed between these jaws is the weft thread 1 running from the spool of the carrier, with the latter moving in the looming-up zone. The spool rotates due to the tension of the weft thread adjusted by the spring 73.

The apparatus also includes a cam 74 (FIGS. 1, 2) for controlling a movable lug of the carrier thread tensioner, mounted on the frame 35 of the loom. The cam 74 is located in a central angle "$\alpha$" of the disk 12 (FIG. 1) within which the threadguides rotate in a sector "$\beta$" limited by the region of divergence of the trajectories of movement of the disk 12 and the conveyer 54 and the region corresponding to the last turn of the threadguide 3 around its axle 53 (FIG. 11) which is close to the axis 11 (FIG. 1) of rotation of the disk 12 and displaced by a value "e" relative to the axle 64 (FIG. 11) of rotation of the spool 4 of the carrier. The apparatus also includes a device for separating a straight section of the thread from the coils placed on the spool of the carrier. This device is made up of a grip 75 (FIGS. 1, 18) and a knife 76 adapted to press the thread against a base 77 (FIG. 18) and to cut it. The grip and the knife execute, in accordance with a cyclogram, an oscillatory motion imparted by a cam 78 mounted on a shaft of the cloth forming mechanism 9, acting upon a roller 79 of a lever 80 mounted together with the grip and the knife on an axle 81. The direction of movement of the carriers 5 is shown by an arrow C (FIG. 1), while the direction of rotation of the disk 12 together with the threadguides 3, by an arrow D. The direction of rotation of the threadguide 3 around its axle 53 is conventionally shown on the drawing by an arrow E.

The threading of the weft thread carriers proceeds as follows.

The ends of the weft threads running from the bobbins 2 (FIG. 2) are passed through the thread tensioner 46, the eyelet of the lever-compensator 36, the threadguide axle 53, the threadguide 3 and the grip 49 for the end of the weft thread.

As the loom is started, the motion from the electric motor (not shown) is imparted to the disk 12 which rotates at a constant speed around the is 11 (FIG. 1). With the disk 12 rotating, the teeth 62 (FIG. 2) thereof engage the links 56 (FIG. 4) of the conveyer 54 (FIG. 2) thereby causing the latter to move. The conveyer 54 moving in step with the disk 12 propels the weft thread carriers. This causes the winding heads on the disk 12 to move in step with the carriers on the conveyer 54.

The threading process is illustrated in FIG. 1 by reference points F, G, Q, J, K, L, M. The position of elements of one winding head relative to the carrier for each reference point is shown in FIGS. 7–18, respectively.

Figure 7:
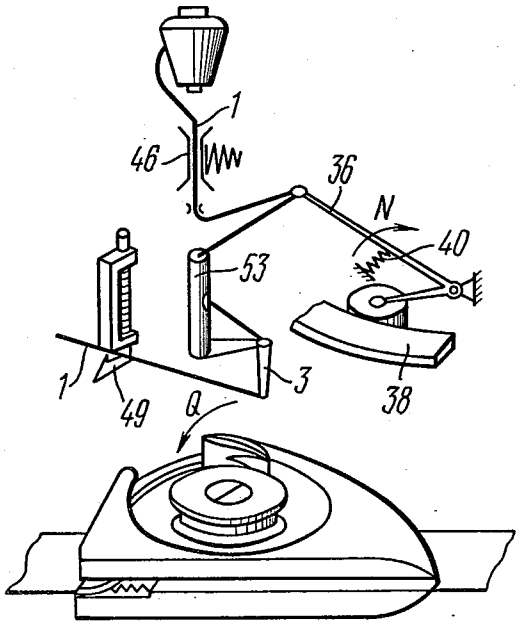
FIG. 7 illustrates a moment of the threading process as a threadguide approaches the next carrier, isometric view.

Reference point F (FIG. 7)

The carrier 5, while moving, approaches a respective winding head. As the disk 12 rotates, the lever-compensator 36 (FIG. 7), when acted upon the cam 38, turns along an arrow "N" and pulls the weft thread 1 through the open grip 49, the threadguide 3 and the axle 53, thereby forming a loop of the weft thread above the axle 53. As a result, a short end of the thread droops from the grip 49. In the course of this pulling, no thread is fed from the bobbin, since it is braked by the thread tensioner 46. The grip is open because during this period the cam 50 (FIG. 2) exerts pressure via the roller 51 and the lever 52 on the movable lug of the grip 49, thereby depressing it to the lowermost position. Due to relative movement of the winding head and the carrier, the grip 49 and the threadguide 3 approach the carrier, while moving along an arrow "O" in the horizontal plane.

Figure 8:
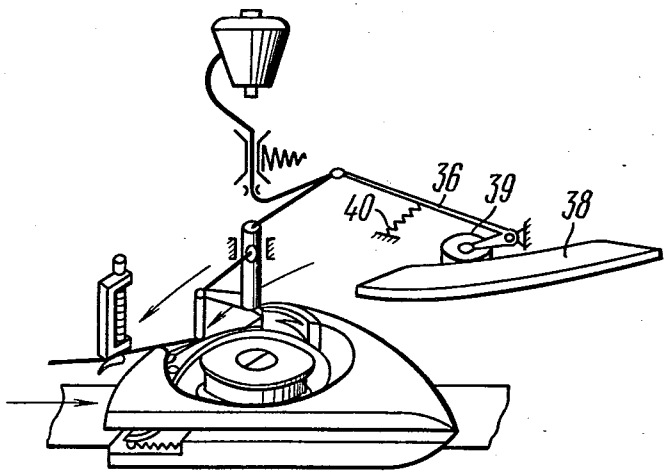
FIG. 8 shows a moment of the threading process before the winding of the thread onto a spool of the carrier is initiated, isometric view.
Figure 9:
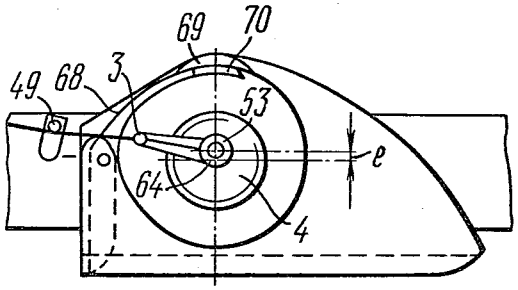
FIG. 9 same as in FIG. 8, top view.

Reference point G (FIGS. 8, 9)

The winding head aligns with a respective carrier whereby the threadguide 3, without turning around its own axis, enters the free space 68 of the carrier so that the axle 53 of the threadguide approaches the axle 11 (FIG. 1) of rotation of the disk 12 and shifted by the value "e" (FIG. 9) relative to the axle 64 of the spool 4 of the carrier. The grip 49 assumes a position outside the carrier body and closes, thereby arresting the end of the weft thread. The grip is closed due to the lever 52 being disengaged from the cam 50 (FIG. 2), as a result of which the movable jaw of the grip 49 is urged against the stationary jaw 47 by the spring 48. The movable jaw 70 of the thread tensioner of the carrier is pressed against the stationary jaw 69. At this reference point, the roller 33 (FIG. 3) of the three-arm lever 30 initiates engagement with the cam 34 (FIG. 2), while the roller 31 (FIG. 3) disengages the fixing disk 14, thereby letting it rotate together with the axle 53 of the threadguide. Simultaneously, the roller 32 disengages the command disk 26.

The forked lever 41 (FIG. 2) stops cooperating with the cam 42, as a result of which the upper semicoupling 24 is relieved of this lever and engaged with the hear semicoupling 21.

Figure 10:
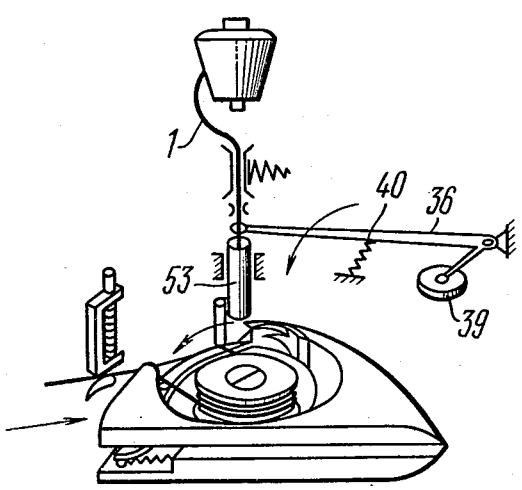
FIG. 10 shows a moment of the threading process as the thread coils are being wound onto a spool of the carrier, isometric view.
Figure 11:
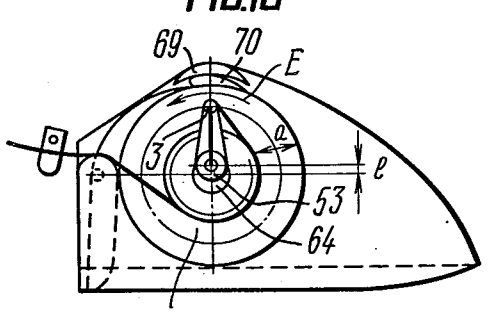
FIG. 11 same as in FIG. 10, top view.

Reference point Q (FIGS. 10, 11)

Due to the increasing radius of the cam 16 (FIG. 2) and as a result of rotation of the disk 12, the toothed sector 19 begins to rotate and transmit a definite number of revolutions to the threadguide 3 through the semicouplings 21, 24, the axle 22 and the gears 27, 28, 29, 13. The threadguide 3, while rotating along the arrow "E" around the spool 4 (FIG. 11), winds the weft thread 1 onto the spool 4. Now, the roller 39 stops interacting with the cam 38 (FIG. 2) and the lever-compensator 36 under the action of the spring 40 (FIG. 10) returns to the initial position, i.e. its eyelet becomes coaxial with the axle 53. The thus released loop of the weft thread is wound around the spool of the carrier, the thread is fed as it is unwound from the bobbin. In the course of winding, the threadguide rotates in the free space "a," whereas the movable jaw 70 of the thread tensioner of the carrier is pressed against the stationary jaw 69. Several turns before the threadguide ceases rotating, the roller 33 (FIG. 3) of the three-arm lever 30 stops cooperating with the cam 34 (FIG. 2) and the three-arm lever, acted upon by the spring 74 (FIG. 3), is pressed by the roller 32 against the command disk 26, following the changes in the profile thereof. During the whole period of winding, the grip 49 is closed, thereby reliably holding the end of the weft thread, whereas the spool 4 of the carrier does not rotate.

Figure 12:
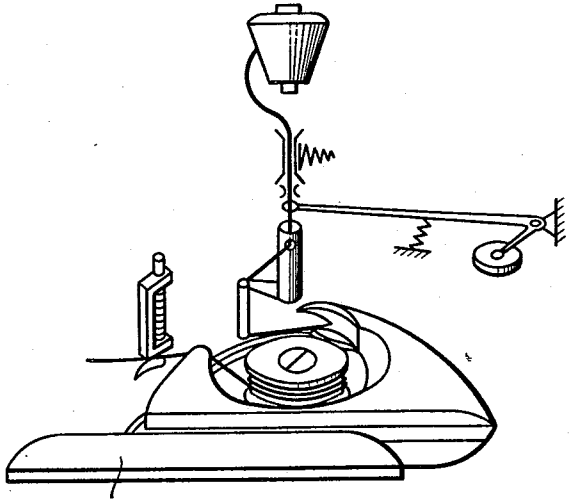
FIG. 12 shows a moment of the threading process when the thread is introduced into a thread tensioner of the carrier during the last turn of the threadguide, isometric view.
Figure 13:
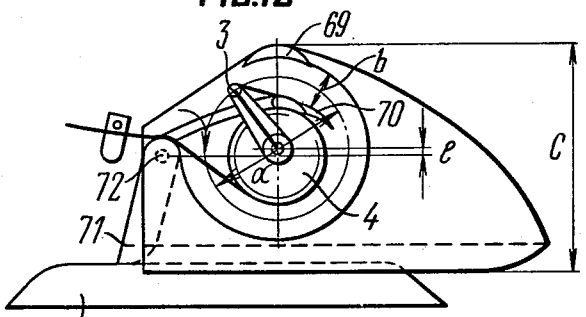
FIG. 13 same as in FIG. 12, top view.

Reference point J (FIGS. 12, 13)

As the threadguide makes its last turn, due to the changing radius of the command disk 26 (FIG. 3) with which the roller 60 is in contact, the three-arm lever 30 continues turning under the action of the spring 74 as a result of which the roller 31 comes into contact with the fixing disk 14 and runs over the latter.

The carrier, while moving, approaches the stationary cam 74 (FIGS. 2, 12, 13) disposed in the sector "$\beta$" of the central winding angle "$\beta$" (FIG. 1) which applies pressure to the bell crank 71 (FIG. 13) and causes it to rotate around the axle 72 due to which the movable jaw 70 of the thread tensioner of the carrier departs from the stationary jaw 69 towards the spool 4. In this case, formed between the movable and stationary jaws is a free space "b" through which the threadguide 3 passes while making the last turn. Therewith, the last coil of the weft thread is placed onto the movable jaw 70 of the thread tensioner rather than on the spool. As this cycle is over, the threadguide stops in the initial position.

The axis of rotation of the threadguide is shifted relative to that of the spool 4 towards the axis of rotation of the disk by value "e". This shift ensures the equality of sizes of the free spaces "b" and "a" (FIG. 11), provided the carrier is of a minimum width "c" (FIG. 13), since, in this case, the diameter of the trajectory of rotation of the threadguide decreases. During this period, the grip 49 is still closed and the spool 63 is stationary.

Figure 14:
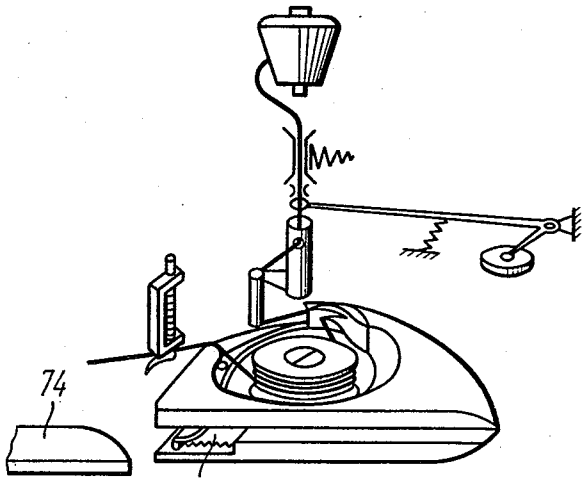
FIG. 14 shows a moment of the threading process when the thread tensioner of the carrier grips the thread after the winding is over and before the carrier and the threadguide start diverging, isometric view.
Figure 15:
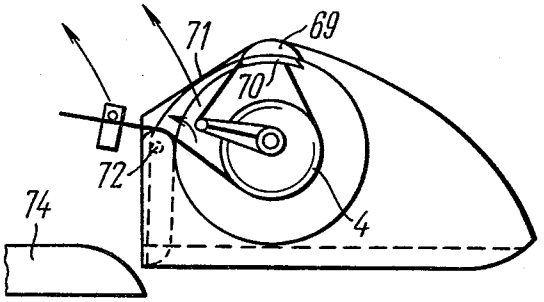
FIG. 15 same as in FIG. 14, top view.

Reference point K (FIGS. 14, 15)

The roller 31 (FIG. 3) in response to the spring 74 engages a recess 82 of the fixing disk 14 thereby fixing the latter and the threadguide in a definite position. This time, the radius of the cam 16 (FIG. 2) becomes constant, and the entire drive system of the threadguide is able to rotate only together with the disk 12 around the axle 11. The cam 42 applies pressure to the roller 52 (FIG. 3) which, through the lever 44, the axle 45 and the forked lever 41, raises the upper semicoupling 24, thereby disengaging it from the gear-semicoupling 21. The carrier stops cooperating with the cam 74 (FIGS. 14, 15) due to which the bell crank 71 under the action of the spring 73 rotates around the axle 72 to reassume the initial position till the movable jaw 70 proves pressed against the stationary jaw 69. As a result, the weft thread is gripped by these two jaws and introduced all the way into the thread tensioner of the carrier. The cam 50 (FIG. 2) exerts pressure through the roller 51 and the lever 52 on the movable jaw of the grip 49 and the latter opens, thereby releasing the end of the weft thread.

Figure 16:
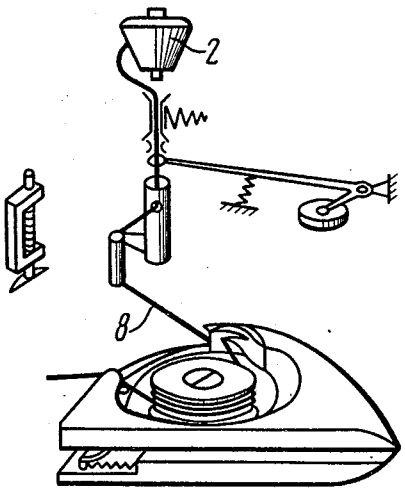
FIG. 16 shows a moment of the threading process when the carrier departs from the threadguide and a straight section of the thread is formed, isometric view.
Figure 17:
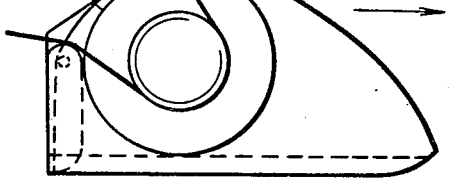
FIG. 17 same as in FIG. 16, top view.

Reference point L (FIGS. 16, 17)

The radius of the cam 16 (FIG. 2) decreases and the toothed sector 19 returns to the initial position as does the gear-semicoupling 21 meshed therewith. The threadguide 3 does not rotate because the upper semicoupling 24 (driven) does not engage the gear-semicoupling 21. The carrier is admitted by the conveyer into the looming-up zone, while the threadguide 3 moves along an arrow "P" out of the free space 68 in the body of the carrier and recedes therefrom. Since the space 68 may be as wide as 20 mm, no strict orientation of the threadguide with respect to the carrier body is required. Due to the departure of the carrier from the threadguide and also due to the gripping of the thread by the carrier thread tensioner, the unwinding of the thread from the bobbin 2 continues accompanied by the formation of the straight section 8 of the thread between the carrier thread tensioner and the threadguide. This makes it possible at a given weaving width of the loom to wind onto the spool a smaller amount of the thread since due to this departure the thread will not unwind from the spool. This, in turn, decreases the speed of rewinding and the bulk of the spool. The grip 49 during this period is open, and the spool of the carrier does not rotate.

Figure 18:
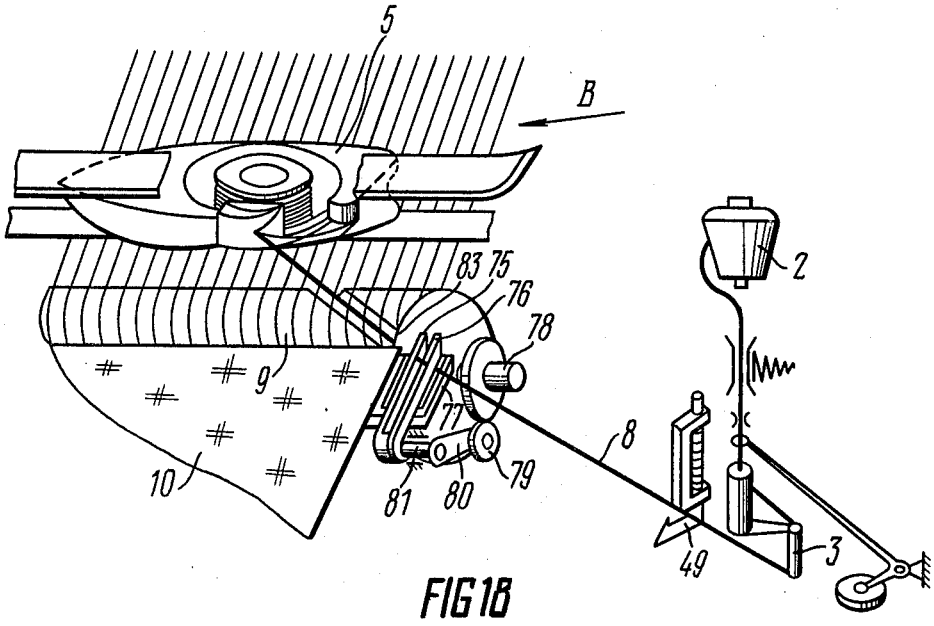
FIG. 18 shows a moment of the threading process when the carrier moves within the looming-up zone and the straight section of the thread is separated from the coils placed on the carrier spool, isometric view.

Reference point M (FIG. 18)

The toothed sector 19, upon reaching the constant radius of the cam 16, stops, thereby causing the gear-semicoupling 21 to stop as well. The threadguide 3 also does not rotate.

Figure 2:
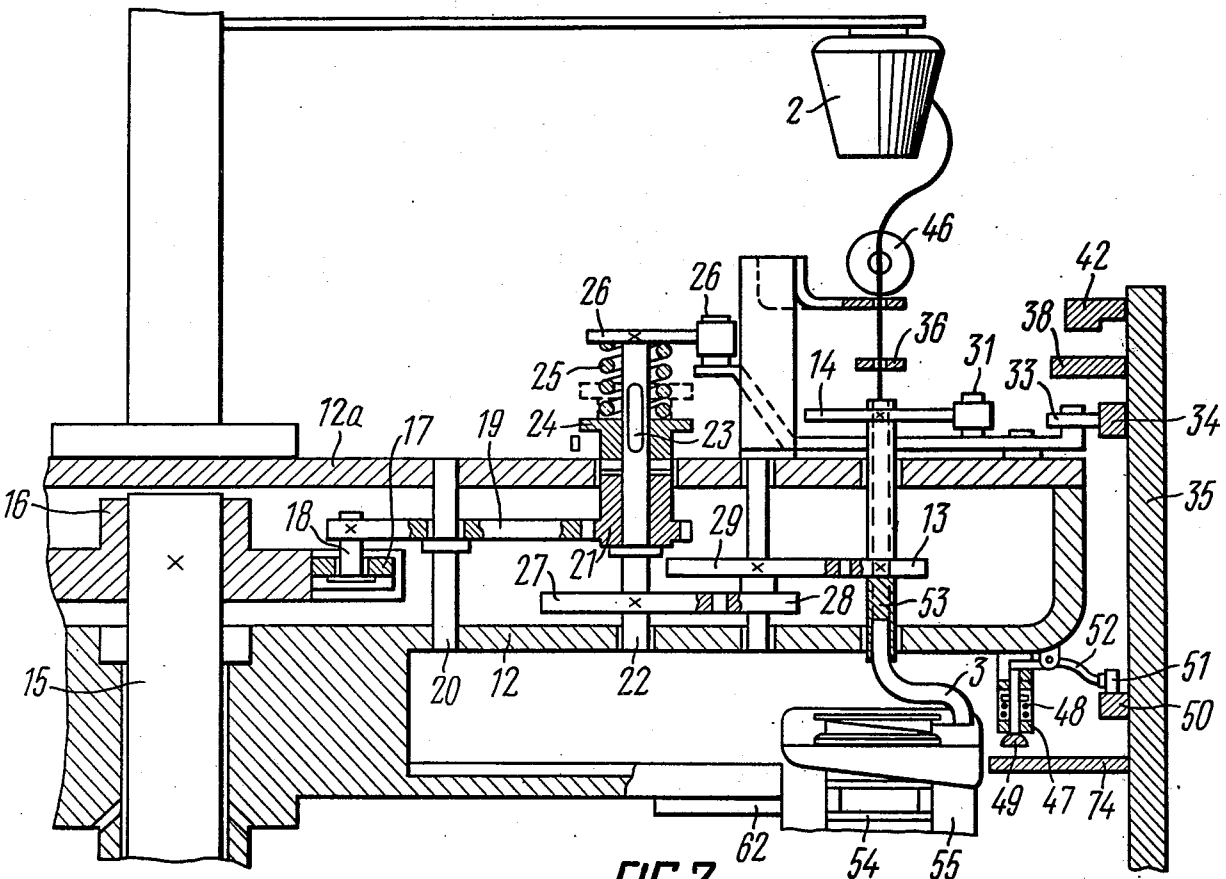
FIG. 2 is a sectional view of the mechanism for threading the weft thread carriers.
Figure 3:
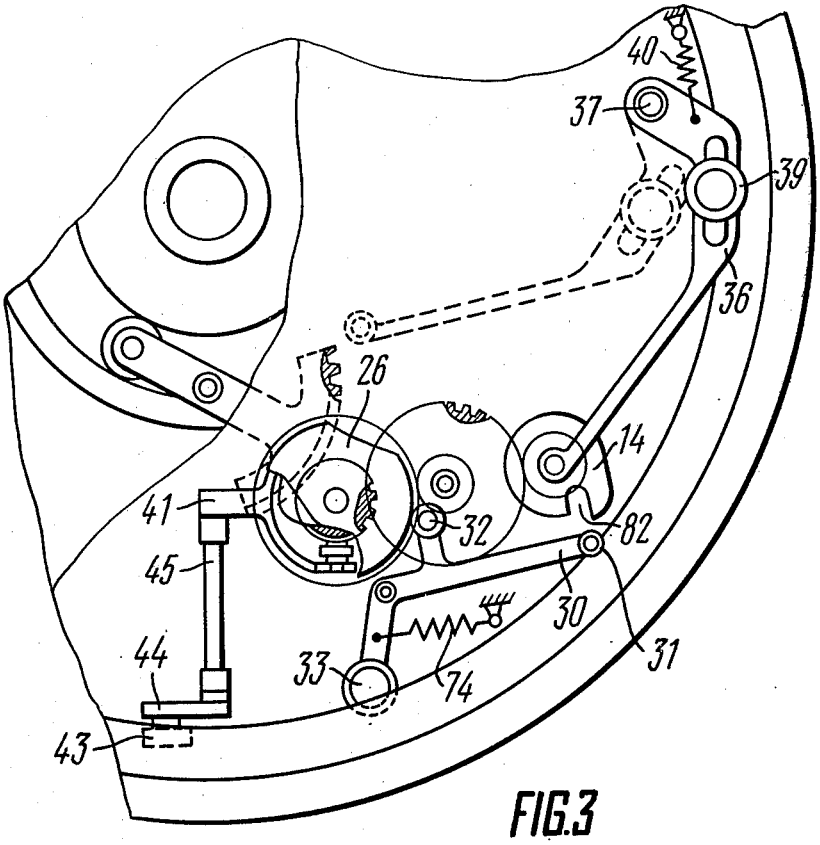
FIG. 3 shows schematically the mechanism for threading the weft thread carriers, top view.

The carrier 5 (FIG. 18) enters the looming-up zone B, while going on receding from a respective winding head which moves along the closed trajectory together with the disk 12 (FIG. 2). Consequently, the distance between the carrier 5 (FIG. 18) and the threadguide 3 increases as does the length of the straight section 8 of the thread being unwound from the bobbin 2. During this movement, due to the rotating disk, the thread is inserted into the open grip 75 and the knife 76 at the edge of the cloth as well as into the open grip 49. Thereafter, the grip 75 is caused to close by the cam 78, thereby nipping the thread, and the knife 76 cuts the latter severing the straight section 8 of the thread from the coils on the spool of the carrier. As soon as the thread is nipped by the grip 75, the unwinding of the thread from the carrier spool is initiated due to the spool rotating under the action of the thread tension. The thread emerging from the thread tensioner of the carrier is engaged by the cloth forming mechanism 9 and advanced thereby towards the fell of the cloth 10. Only after the beating-up of the weft thread at an extreme point 83 of the beginning of the looming-up this thread is interlaced with the warp threads which makes it possible to form the selvage of the cloth with any tension applied to the weft thread and, consequently, to produce a more compact selvage of the cloth. The straight section 8 of the thread is again drawn through the grip and the threadguide and the weft threading cycle repeats itself with the carriers following in succession.

The proposed method of and the apparatus for threading the weft thread carriers on a travelling-wave loom make it possible:

(1) to more reliably thread the thread tensioners of the carriers;

(2) to rule out the necessity for strict orientation of the threadguides when rotation is stopped;

(3) to reduce both the speed of rewinding of the thread and the bulk of the spools of the carriers;

(4) to obtain a more compact selvage of the cloth.

What is claimed is:

1. A method of threading spools of weft thread carriers in a travelling-wave loom apparatus, said loom apparatus including a substantially horizontally extending rotatable disk, said disk having a plurality of thread wound bobbins and a plurality of winding heads associated therewith, the winding heads including a plurality of threadguides rotatably mounted proximate to the periphery of said disk said loom apparatus further including carrier apparatus including a plurality of carrier spools mounted on a conveyor having a trajectory adapted to carry each of the spools into and out of operative engagement with respective ones of said winding heads, said loom apparatus further including a looming-up zone spaced from said disk, said method comprising the steps of: arranging a thread on a bobbin, said thread having a free end; inserting the free end of the thread into a threadguide; nipping the thread free end with a grip; conveying a carrier spool into association with a threadguide; rotating the thread-guide around the carrier spool, while maintaining the spool rotatably stationary, whereby the thread is unwound from the bobbin and wound onto the said carrier spool in the form of coils; inserting the weft thread into a thread tensioner associated with the carrier spool while the last coil thereof is wound; gripping this thread in the thread tensioner; conveying the carrier spool out of association with the threadguide and introducing the carrier spool together with the gripped thread into the looming-up zone while maintaining said threadguide in a nonrotatable mode; unwinding the weft thread from the bobbin as a result of the departure of the threadguide from the carrier spool and the maintenance of the threadguide in a nonrotatable mode, with simultaneous formation of a straight section of the weft thread; introducing the thread into a grip with subsequent gripping thereof; severing the coils of the weft thread on the carrier spool from the straight section thereof with formation of a free end of the thread at the grip for successive threading of a next carrier spool with the weft thread.

2. A method as recited in claim 1, wherein in the step of unwinding of the weft thread from the bobbin, the severance of the straight section is accomplished prior to interlacing with the edging warp threads.

3. Apparatus for threading carrier spools of weft thread carriers in a traveling-wave loom apparatus including a looming-up zone comprising: a weft thread carrier assembly including a plurality of carrier spools for accomodating coils of the weft thread, said carrier spools being rotatably mounted on a conveyor means such that said carrier spools are aligned in the direction of movement of said conveyor means, a substantially horizontally extending rotatable disk having a plurality of thread wound bobbins and a plurality of winding heads associated therewith, said winding heads including a plurality of thread guides rotatably mounted proximate to the periphery of said disk, each of said threadguides having an axis of rotation extending substantially parallely to the axis of rotation of said disk; said conveyor means comprising means for bringing into coincidence the trajectories of movement of said carrier spools and threadguides and moving the same in synchronism, this zone of coincidence of the trajectories having a region of convergence and a region of divergence of the trajectories; means for unwinding the thread from the bobbin and rotating the threadguides to wind the thread in the form of coils around respective carrier spools; said carrier assembly further including a plurality of thread tensioners, each thread tensioner being associated with a respective carrier spool, and including a pair of jaws for gripping the thread; means for opening each of said thread tensioner jaws while the respective thread tensioner moves through a sector of rotation of said disk between said region of divergence and the region wherein said threadguide associated with said thread tensioner undergoes its last coil-forming rotation; whereby rotation of the threadguide introduces the last thread coil between said thread tensioner jaws; means for closing the thread tensioner jaws to grip said thread in the last coil prior to said carrier spool moving past the region of divergence of trajectories; whereby subsequent movement of the carrier spool beyond the region of divergence toward the looming-up zone causes thread to be unwound from the bobbin while the thread on the carrier spool is not unwound, thereby forming a straight thread section.

4. Apparatus as recited in claim 3 wherein said jaw opening means comprises a cam member located on said disk within said sector of rotation.

5. An apparatus as claimed in claim 4, wherein the movable jaw member is located on a bell crank with the axis of rotation thereof being disposed behind the spool in the direction of advance of the carrier, a free arm of this lever cooperating with the cam for the jaws, whereby a space is formed therebetween to accommodate the threadguide with the weft thread, for the latter to be gripped before the straight section thereof is formed.

6. Apparatus as recited in claim 3 wherein the axis of rotation of each of said threadguides is substantially parallel to and slightly displaced from the axis of rotation of each of said respective spools.

* * * * *